US009479852B2

(12) United States Patent
Yang et al.

(10) Patent No.: US 9,479,852 B2
(45) Date of Patent: Oct. 25, 2016

(54) SPEAKER'S FAST INSTALLATION ASSEMBLY

(71) Applicant: HIGH HIT ENTERPRISE CO., LTD, New Taipei (TW)

(72) Inventors: Chin-Teh Yang, New Taipei (TW); Jin-Xin Zhang, New Taipei (TW); Cheng Huang, New Taipei (TW)

(73) Assignee: HIGH HIT ENTERPRISE CO., LTD, New Taipei (TW)

( * ) Notice: Subject to any disclaimer, the term of this patent is extended or adjusted under 35 U.S.C. 154(b) by 78 days.

(21) Appl. No.: 14/622,178

(22) Filed: Feb. 13, 2015

(65) Prior Publication Data

US 2016/0241940 A1 Aug. 18, 2016

(51) Int. Cl.
*H04R 1/02* (2006.01)

(52) U.S. Cl.
CPC ..... *H04R 1/025* (2013.01); *H04R 1/026* (2013.01); *H04R 2201/021* (2013.01); *H04R 2201/029* (2013.01)

(58) Field of Classification Search
CPC ..... H04R 1/02; H04R 1/025; H04R 1/026; H04R 2201/021; H04R 2201/029; F21V 21/047; F16B 9/023
See application file for complete search history.

(56) References Cited

U.S. PATENT DOCUMENTS 5,331,119 A * 7/1994 Leger ..... H04R 1/025 181/150
5,964,523 A * 10/1999 Eversberg ..... F21V 21/04 362/148
6,101,262 A * 8/2000 Haase ..... H04R 1/24 181/153
6,578,808 B1 * 6/2003 Bertagni ..... H04R 1/025 248/343
6,588,543 B1 * 7/2003 Tchilinguirian ..... F21V 21/04 181/150
7,172,160 B2 * 2/2007 Piel ..... F16B 13/0808 248/231.9
7,334,767 B2 * 2/2008 Wright ..... B25B 13/46 248/342
7,731,130 B2 * 6/2010 Decanio ..... H04R 1/2873 248/27.3
8,023,664 B2 * 9/2011 Yang ..... H04R 1/025 181/150
8,256,728 B2 * 9/2012 Wright ..... H04R 1/025 181/150
8,485,487 B2 * 7/2013 Cheng ..... H04R 1/026 248/201
8,490,938 B2 * 7/2013 Peng ..... H04R 1/025 181/150
8,672,087 B2 * 3/2014 Stewart, Jr. ..... H04R 1/02 181/148
8,899,374 B2 * 12/2014 Tanaka ..... H04R 1/026 181/150
9,084,046 B2 * 7/2015 Ivey ..... H04R 1/025
2004/0047487 A1 * 3/2004 Popken ..... H04R 1/025 381/395
2007/0121988 A1 * 5/2007 Merrey ..... H04R 1/025 381/386
2008/0044053 A1 * 2/2008 Belanger ..... H04R 1/023 381/391
2009/0245567 A1 * 10/2009 Egyud ..... H04R 1/023 381/395
2009/0324004 A1 * 12/2009 Yang ..... H04R 1/025 381/395
2010/0040254 A1 * 2/2010 Wright ..... H04R 1/02 381/395
2011/0017889 A1 * 1/2011 Nelson ..... B60R 11/0217 248/229.23
2016/0227306 A1 * 8/2016 Shiojima ..... H04R 1/025
2016/0227307 A1 * 8/2016 Shiojima ..... H04R 1/026

FOREIGN PATENT DOCUMENTS

CN 202182302 U 4/2012

* cited by examiner

*Primary Examiner* — Curtis Kuntz
*Assistant Examiner* — Joshua Kaufman
(74) *Attorney, Agent, or Firm* — Chun-Ming Shih

(57) ABSTRACT

A speaker's fast installation assembly includes one ring portion and a plurality of fixing units. Each fixing unit includes an upper cylindrical portion, a lower cylindrical portion and a spring. Each lower cylindrical portion has an L shape and includes a vertical cylindrical part and a horizontal part, which horizontally extends from a lower portion of the vertical cylindrical part.

9 Claims, 9 Drawing Sheets

SPEAKER'S FAST INSTALLATION ASSEMBLY

BACKGROUND OF THE INVENTION

1. Field of the Invention

The invention generally relates to speaker's installation. More particularly, the invention relates to an assembly that enables fast installation of speakers.

2. Description of the Prior Art

In the prior art, to install speakers in a ceiling or a wall, first, holes are drilled in the ceiling or wall and then speakers are installed onto the holes so as to save space and to embellish the appearance. Also, in such installation, affixing devices must be used to affix the speakers onto these holes.

In the patent no. 201120169699.6 of China (of utility and design patent), a ceiling speaker's affixing and easy installation unit was disclosed. The installation unit comprises a vertical plate, a torsion spring, a pivotal member, a vertical connective member and a retaining member. The torsion spring is fixedly disposed onto the vertical plate. The pivotal member is pivotally disposed on the vertical plate. The vertical connective member may move vertically on the vertical plate. The retaining member is pivotally disposed on the vertical plate and is acted upon by a torsion spring. As a portion of the vertical connective member is pressed against by a bottom surface of a ceiling, the pivotal member may be actuated to be undone of its being-pressed-against condition so as to actuate the torsion spring to firmly hold the ceiling in position.

Though the installation unit is easy to install, it is structurally complex and comprises too many components; therefore, its cost is relatively higher. In addition, it may be installed onto ceilings and walls with a narrow range of thickness.

SUMMARY OF THE INVENTION

The object of the present invention is to provide a speaker's fast installation assembly that is structurally simple and easy to install and dismount and has a lower cost.

To reach the object, the speaker's fast installation assembly of the present invention is provided. The assembly of the present invention comprises one ring portion and a plurality of fixing units. Each fixing unit comprises an upper cylindrical portion, a lower cylindrical portion and a spring. Each lower cylindrical portion has an L shape and comprises a vertical cylindrical part and a horizontal part, which horizontally extends from a lower portion of the vertical cylindrical part. The vertical cylindrical part may be upwardly inserted into a bore of the upper cylindrical portion and may move vertically inside the bore. A chamber is provided in the upper cylindrical portion and a fixing notch is provided in an upper portion of the chamber. The spring is mounted inside the bore of the upper cylindrical portion and between the top surface of the vertical cylindrical part and the upper surface of the bore of the upper cylindrical portion. The lower end of each upper cylindrical portion is fixedly connected to the ring portion and an installation hole is provided for each fixing unit in the ring portion. A slot is provided in the bottom surface of each vertical cylindrical part.

In addition, a protruding member is provided on a lower portion of either side of the upper cylindrical portion and a plurality of seating units, whose number equals that of the fixing units, are provided on the top surface of the ring portion. Each seating unit has an inner space, which has a special shape to allow a tight fit with the two protruding members. Bolts or screws are used to affix the two protruding members onto the ring portion and a slot, which faces outwards, is provided in each seating unit so as to provide room for the corresponding horizontal parts.

Moreover, the slot provided in the bottom surface of each vertical cylindrical part may be a slotted screwdriver slot, a Phillips screwdriver slot or a hex key slot.

A hole is provided inside the vertical cylindrical part so as to reduce the height of each fixing unit.

Also, a slope that leads to a lower part of the fixing notch is provided in the upper cylindrical portion.

The ring portion has a ring shape. The seating units and the installation holes of the seating units are provided on top of the upper surface of the ring portion in a circumferentially equally spaced manner.

The speaker's fast installation assembly further comprises a plurality of actuating units, whose number equals that of the fixing units, characterized in that each actuating unit has an L shape. Each actuating unit comprises a trigger, an actuating portion and a pivotal pin, which acts as a pivotally connective device that can connect each actuating unit to the ring portion. A plurality of slots are circumferentially provided in an outer vertical wall of the ring portion so as to allow the triggers to stick out. Each trigger moves into the slot when each actuating portion is located by the corresponding fixing notch and each trigger moves out from the slot and reach a position higher than the top surface of the ring portion when the corresponding actuating portion moves out of the corresponding fixing notch.

A torsion spring is provided for each actuating unit and the ring part of a torsion spring is mounted on the pivotal pin. The stationary member of the torsion spring is affixed to the ring portion and the movable member of the torsion spring is attached to the actuating portion. Each torsion spring may cause the corresponding trigger to jump up and stick out the corresponding slot and to reach a position higher than the top surface of the ring portion and to prompt the actuating portion to move away from the fixing notch.

A U-shaped plate and a screw are provided for each actuating unit and each U-shaped plate may press downwards on the pivotal pin. Also, a seating unit is provided for each actuating unit in the ring portion and has two indentations to hold the pivotal pin in position. Each screw may affix the corresponding U-shaped plate onto each seating unit.

In installation, first, we may use a hex key or other tool to push the lower cylindrical portion of each of the four fixing units inwards through the installation hole. Then, as the top surface of the ring portion approaches a ceiling or wall, the circular perimeter of the opening pushes the four triggers downwards to cause the actuating portion to move the horizontal part outwards so that with the aid of the spring, the horizontal part would slide down along the slope and the chamber and presses downwards on the ceiling, firmly affixing the installation assembly and the speaker onto the ceiling. In disassembly or dismounting, we may push a hex key or other tool inwards to reach the hex slot located in the bottom surface of the vertical cylindrical part and then push the hex key all the way into the hex slot and turn it in the counter-clockwise direction to rotate the lower cylindrical portion so that the horizontal part of the lower cylindrical portion moves up inside the chamber and moves into the fixing notch and then is locked in the fixing notch and that the actuating unit returns to its original position thanks to the torsion spring.

The speaker's fast installation assembly of the present invention is structurally simple, safe and sturdy and has a longer service life. Because most of its parts may be manufactured by injection molding, its cost is relatively lower. In addition, its installation and disassembly are simple and easy; therefore, efficiency is greatly enhanced. Moreover, no damage would be done to the ceiling in its installation and disassembly. Furthermore, it may be installed in ceilings and walls in a wide range of thickness.

DETAILED DESCRIPTION OF THE PREFERRED EMBODIMENT

Figure 1:
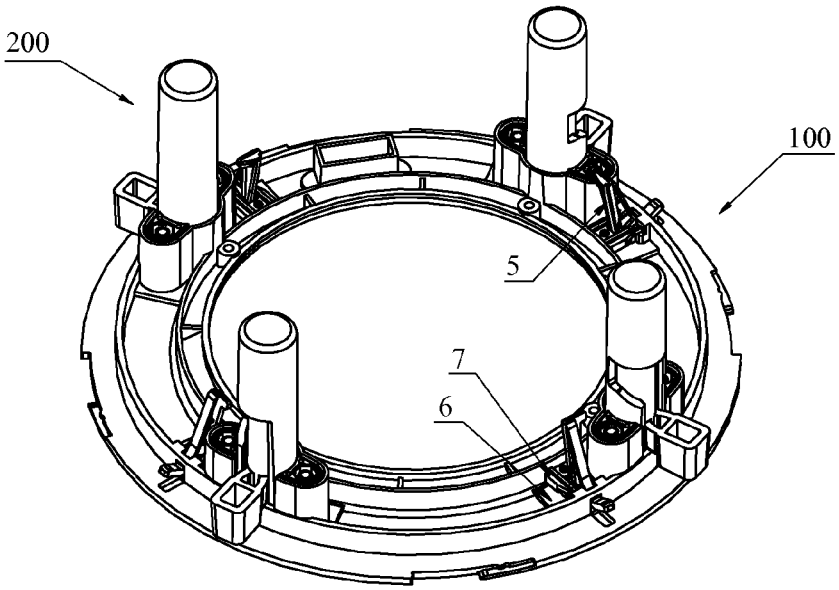
FIG. 1 is a perspective view of the speaker's fast installation assembly of the present invention.
Figure 2:
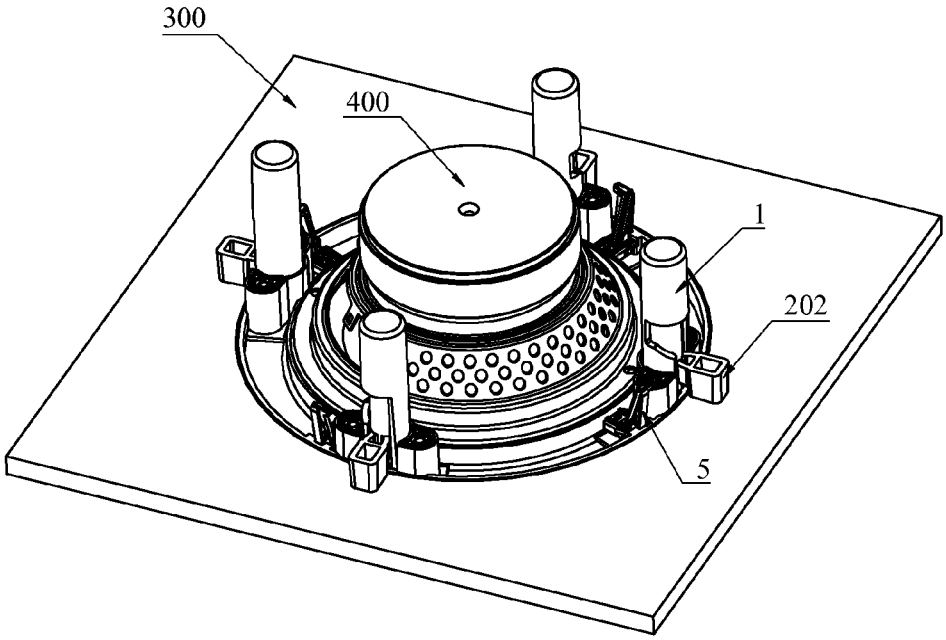
FIG. 2 is a perspective view of the fast installation assembly of the present invention in an installed condition.
Figure 3:
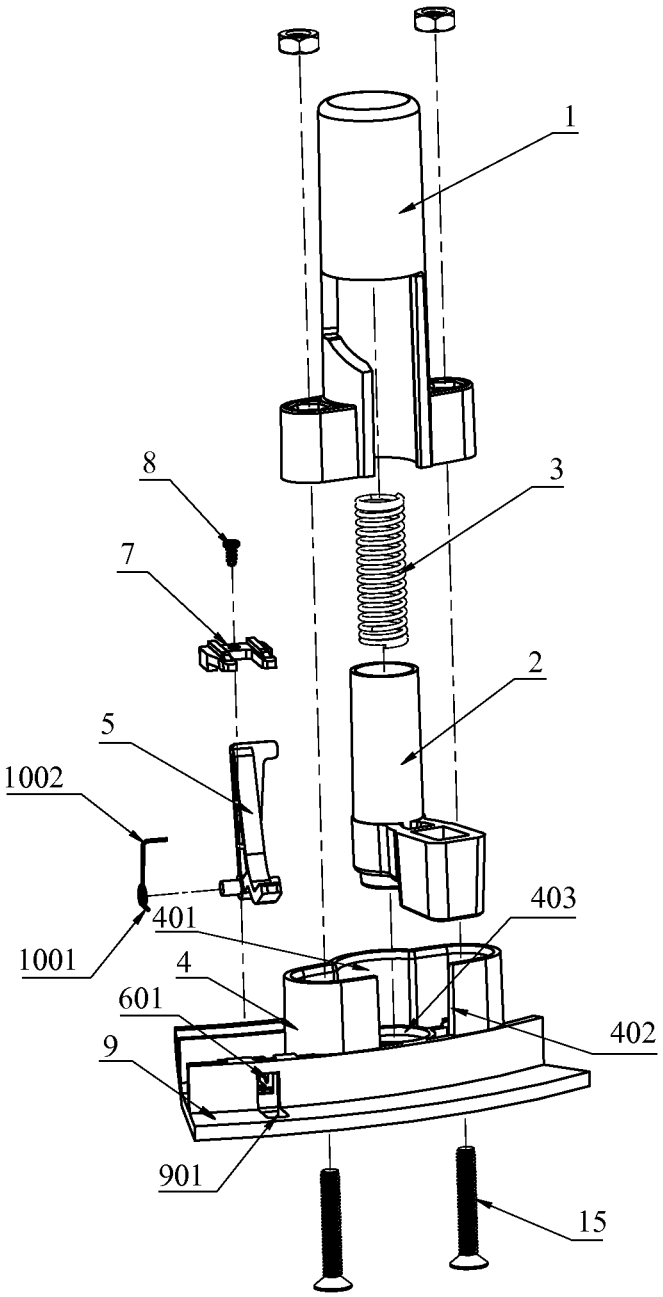
FIG. 3 is an exploded view of each fixing unit of the fast installation assembly of the present invention.
Figure 4:
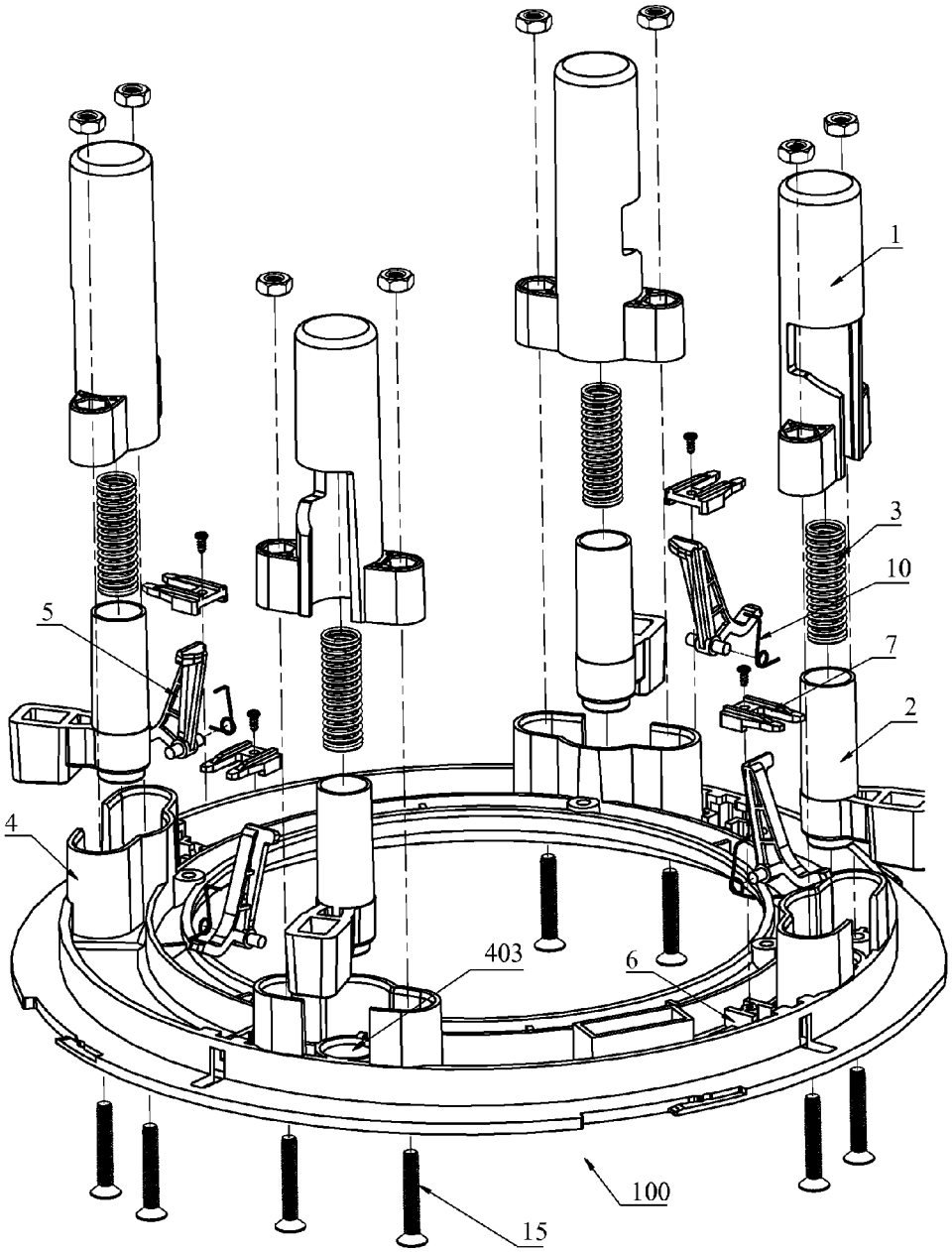
FIG. 4 is an exploded view of the fast installation assembly of the present invention.
Figure 5:
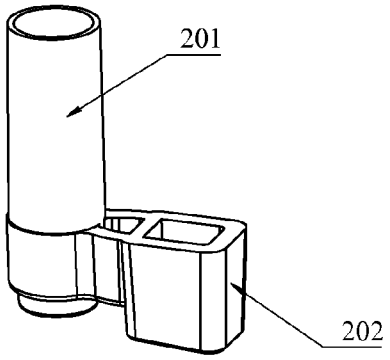
FIG. 5 is a perspective view of each horizontal part of the fast installation assembly of the present invention.
Figure 6:
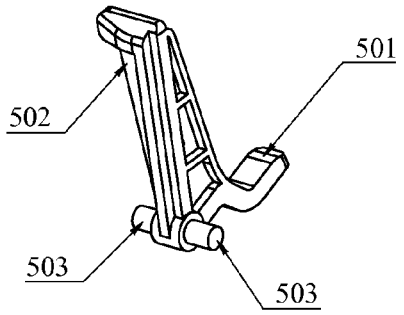
FIG. 6 is a perspective view of the actuating unit of the fast installation assembly of the present invention.
Figure 7:
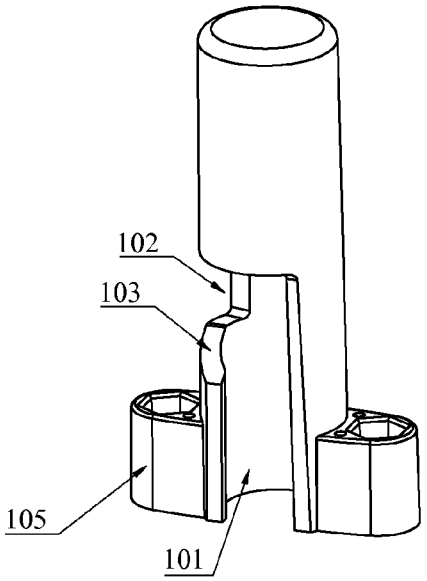
FIG. 7 is a perspective view of the upper cylindrical portion of the fast installation assembly of the present invention.
Figure 8:
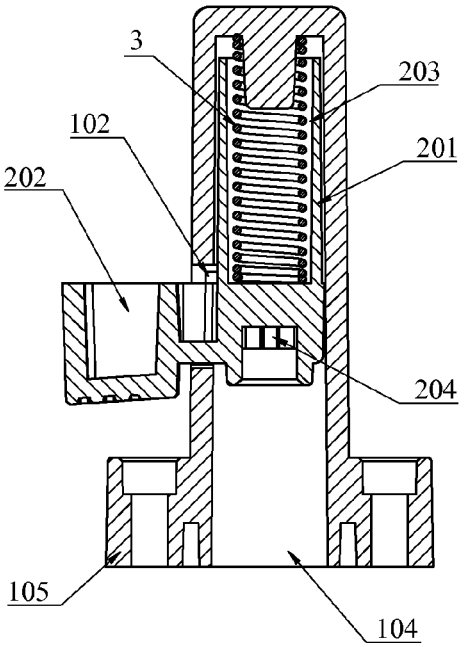
FIG. 8 is a sectional view of the fixing unit of the fast installation assembly of the present invention with the actuating unit removed.

As illustrated in FIGS. 1 to 8, the speaker's fast installation assembly of the present invention comprises one ring portion 100 and four fixing units 200. The four fixing units 200 are mounted on top of the upper surface of the ring portion 100 in a circumferentially equally spaced manner.

Each fixing unit 200 comprises an upper cylindrical portion 1, a lower cylindrical portion 2 and a spring 3. Each lower cylindrical portion 2 has an L shape and comprises a vertical cylindrical part 201 and a horizontal part 202, which horizontally extends from a lower portion of the vertical cylindrical part 201. The vertical cylindrical part 201 may be upwardly inserted into a bore of the upper cylindrical portion 1 and may move vertically inside the bore 104.

A chamber 101 is provided in the upper cylindrical portion 1 so as to allow the entry of each lower cylindrical portion 2. A fixing notch 102 is provided in an upper portion of the chamber 101 so as to fix the horizontal part 202. A slope 103 that leads to a lower part of the fixing notch 102 is provided in the upper cylindrical portion 1 so as to facilitate the entry of the horizontal part 202 into the fixing notch 102. The height of the fixing notch 102 is greater than the height of the horizontal part 202 and the gap Δ is difference between these two heights.

The spring 3 is mounted inside the bore of the upper cylindrical portion 1 and between the top surface of the vertical cylindrical part 201 and the bottom surface of the bore of the upper cylindrical portion 1. A hole 203 is provided inside the vertical cylindrical part 201 so as to reduce the height of each fixing unit 200.

The bottom surface of the vertical cylindrical part 201 is provided with a slot 204, which may be a slotted screwdriver slot, a Phillips screwdriver slot or a hex key slot In this embodiment, the slot 204 is a hex key slot 204, which may engage with a hex key.

A protruding member 105 is provided on a lower portion of either side of the upper cylindrical portion 1. Four seating units 4 are provided on the top surface of the ring portion 100 in a circumferentially equally spaced manner. Each seating unit 4 has an inner space 401, which has a special shape to allow a tight fit with the two protruding members 105. Two bolts 15 or screws are used to affix the two protruding members 105 onto the ring portion 100. A slot 402 is provided in each seating unit 4 so as to provide room for the corresponding horizontal part 202.

A hole 403 is provided under each inner space 401 and a total of four holes 403 are disposed in the ring portion 100 in a circumferentially equally spaced manner. Through each hole 403, we may use a hex key 500 to reach the slot 204 located in the bottom surface of the vertical cylindrical part 201.

An actuating unit 5 is mounted by each fixing unit 200 and is L-shaped. The actuating unit 5 comprises a trigger 501, an actuating portion 502 and a pivotal pin 503, which acts as a pivotally connective device.

A seating unit 6 is provided for each actuating unit 5 in the ring portion 100 and has two indentations 601 to hold the pivotal pin 503 in position. A U-shaped plate 7 may presses downwards on the pivotal pin 503 to affix the latter. A screw 8 is used to affix the U-shaped plate 7 onto each seating unit 6.

Figure 10:
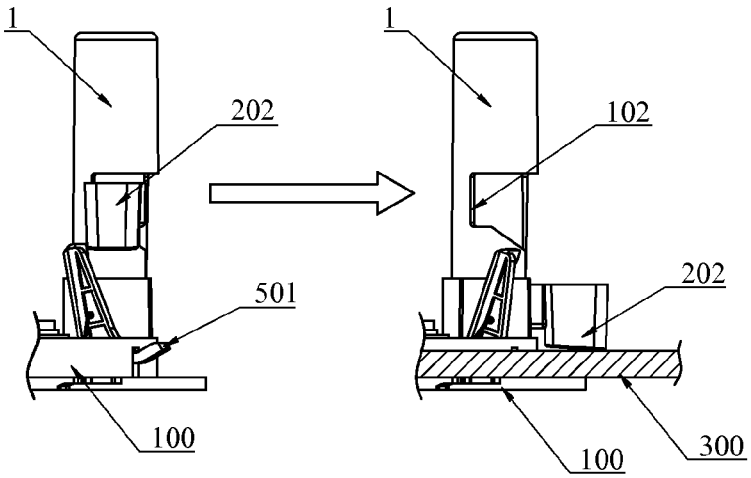
FIG. 10 is a side view illustrating how the actuating unit works in the installation.
Figure 11:
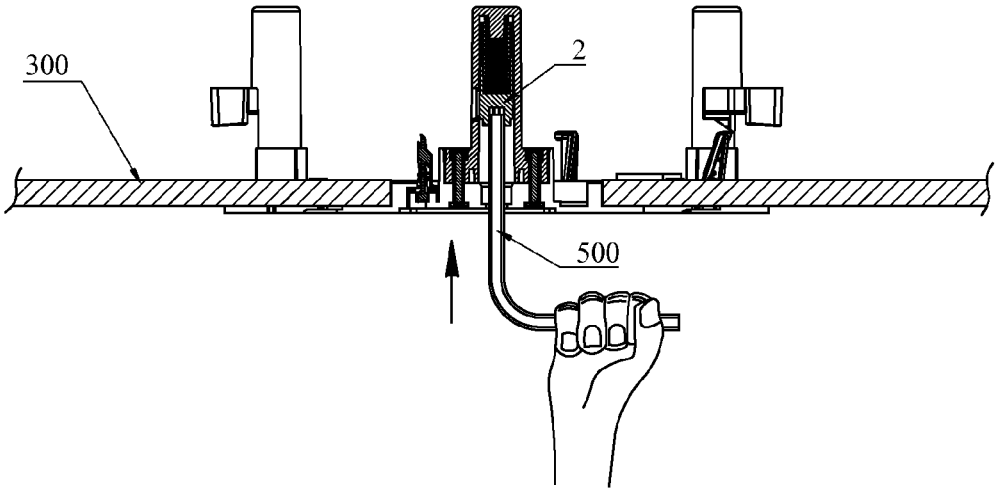
FIG. 11 is a side view illustrating the first step in unlocking each locking unit.
Figure 12:
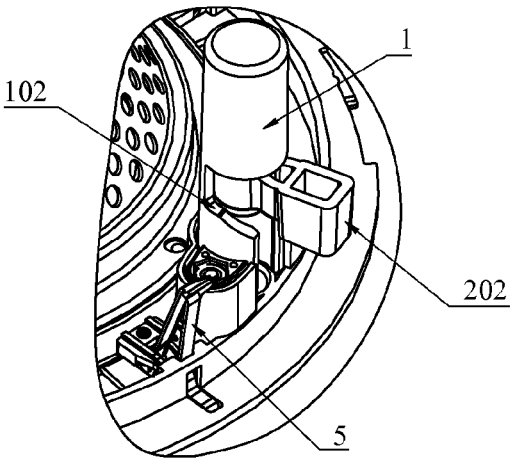
FIG. 12 is an enlarged perspective side view illustrating the first step in unlocking each locking unit.
Figure 13:
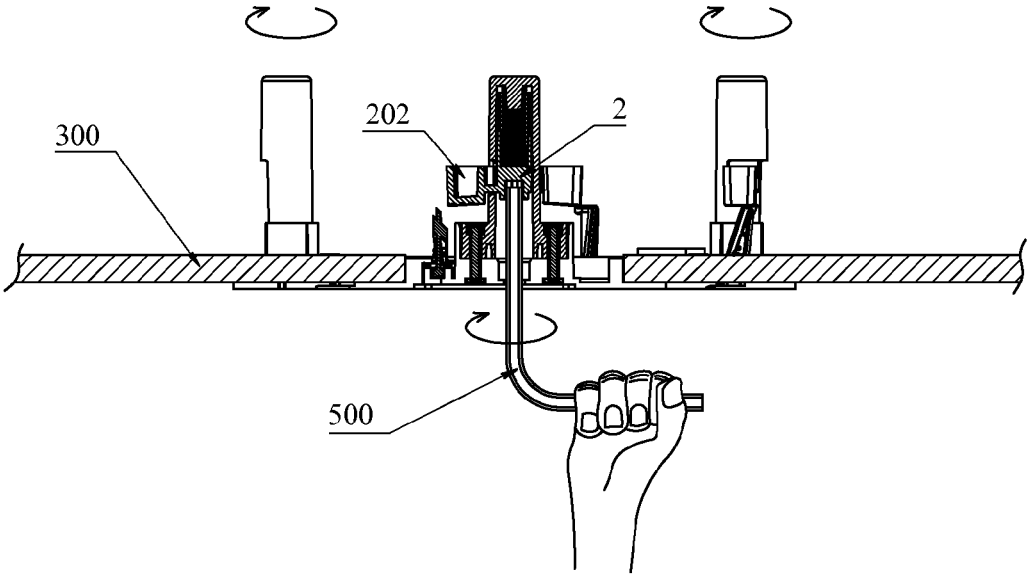
FIG. 13 is a side view illustrating the second step in unlocking each locking unit.
Figure 14:
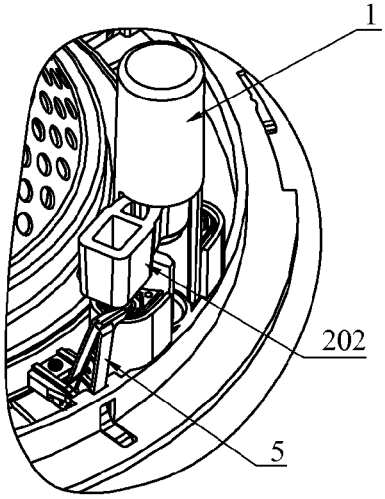
FIG. 14 is an enlarged perspective side view illustrating the second step in unlocking each locking unit.
Figure 15:
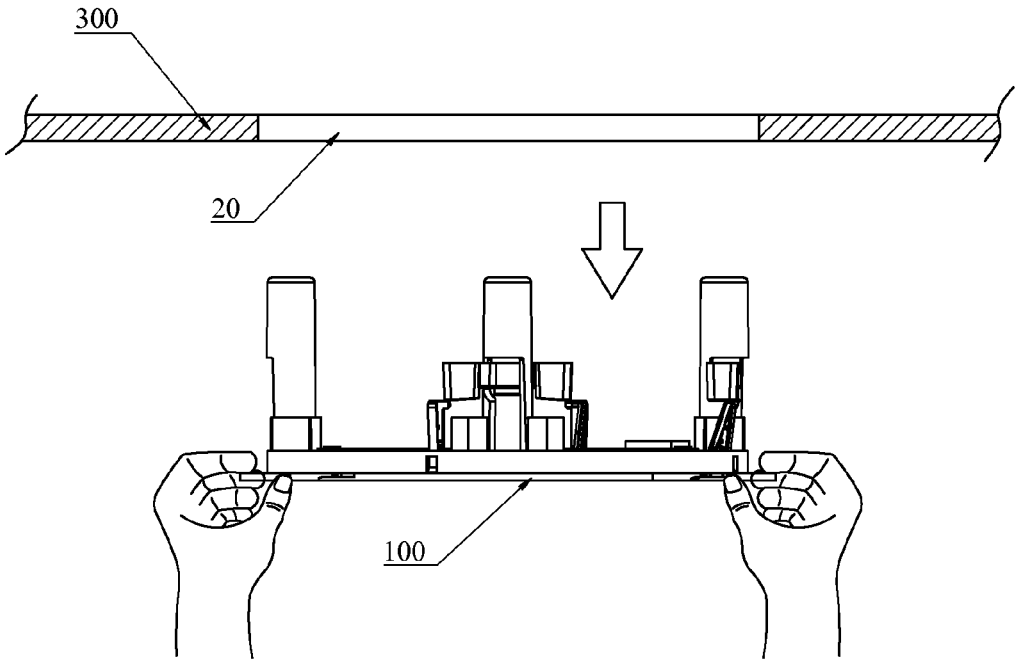
FIG. 15 is a side view illustrating how the speaker's fast installation assembly of the present invention and a speaker is dismounted from a ceiling.

Four slots 901 are circumferentially provided in an outer vertical wall 9 of the ring portion 100 so as to allow the triggers 501 to stick out. As illustrated in FIG. 10, each trigger 501 moves into the slot when each actuating portion 502 is located by the corresponding fixing notch 102 and each trigger 501 moves out from the slot 901 and reaches a position higher than the top surface 9 of the ring portion 100 when the corresponding actuating portion 502 moves out of the corresponding fixing notch 102.

The ring part of a torsion spring 10 is mounted on the pivotal pin 503; the stationary member 1001 of the torsion spring 10 is affixed to the ring portion 100 and the movable member 1002 of the torsion spring 10 is attached to the actuating portion 502. Each torsion spring 10 may cause the corresponding trigger 501 to jump up and stick out the corresponding slot 901 and to reach a position higher than the top surface 9 of the ring portion 100 and to prompt the actuating portion 502 to move away from the fixing notch 102.

In the installation of a speaker 400 onto a ceiling 300, first, use a hex key 500 to push the lower cylindrical portion 2 of each of the four fixing units 200 inwards and turn in the counter-clockwise direction into the condition illustrated in FIG. 10.

Now, the horizontal part 202 moves into the corresponding fixing notch 102.

Also, as illustrated in the left drawing of FIG. 10, the actuating portion 502 leans backwards and the trigger 501 ascends to stick out of the top surface 9.

Figure 9:
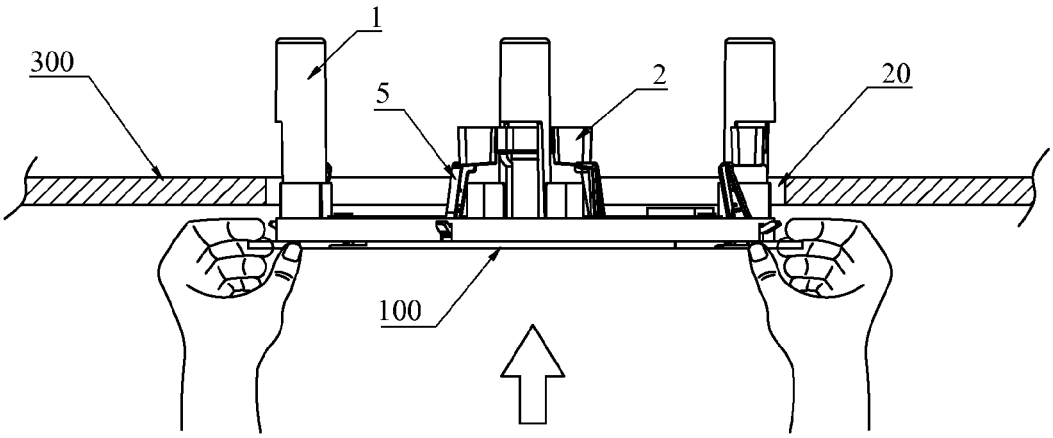
FIG. 9 is a side view illustrating how the fast installation assembly of the present invention is installed.

Next, as shown in FIG. 9, insert the installation assembly with the speaker into an opening 20 in the ceiling 300. The circular perimeter of the opening 20 pushes the four triggers 501 downwards to cause the actuating portion 502 to move the horizontal part 202 outwards. With the aid of the spring 3, the horizontal part 202 would slide down along the slope 103 and the chamber 101 and presses downwards on the ceiling 300, firmly affix the installation assembly and the speaker to the ceiling 300.

Now, as illustrated in the right drawing of FIG. 10, the actuating portion 502 leans forwards; the actuating portion 502 has moved out of the fixing notch 102; each trigger 501 is under the ceiling 300 and in the corresponding slot 901.

As illustrated from FIGS. 11 to 15, we may easily take the assembly off the ceiling by using a hex key 500 to unlock the four fixing units 200 as elaborated in the following.

To unlock each locking unit 200, we may push a hex key 500 inwards to reach the hex slot 204 located in the bottom surface of the vertical cylindrical part 201 and then push the hex key 500 all the way into the hex slot 204 and turn it in the counter-clockwise direction to rotate the lower cylindrical portion 2. Now, the horizontal part 202 of the lower cylindrical portion 2 moves up inside the chamber 101 and moves into the fixing notch 102 and then is locked in the fixing notch 102. Therefore, the fixing unit 200 is unlocked.

Figure 16:
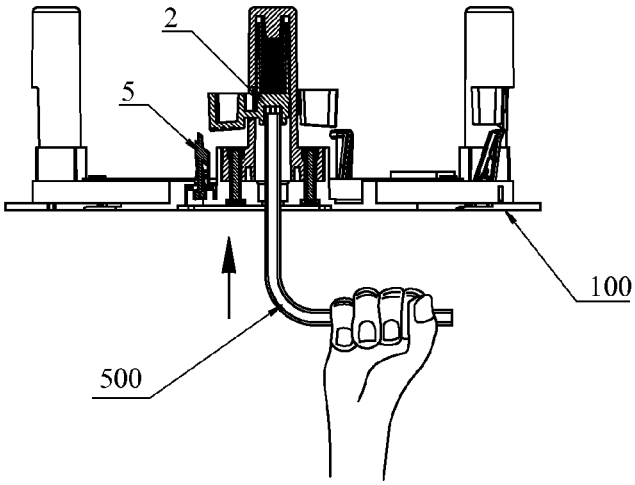
FIG. 16 is a side view illustrating that we may use a hex key to push the vertical cylindrical part upwards after the locking unit is unlocked.
Figure 17:
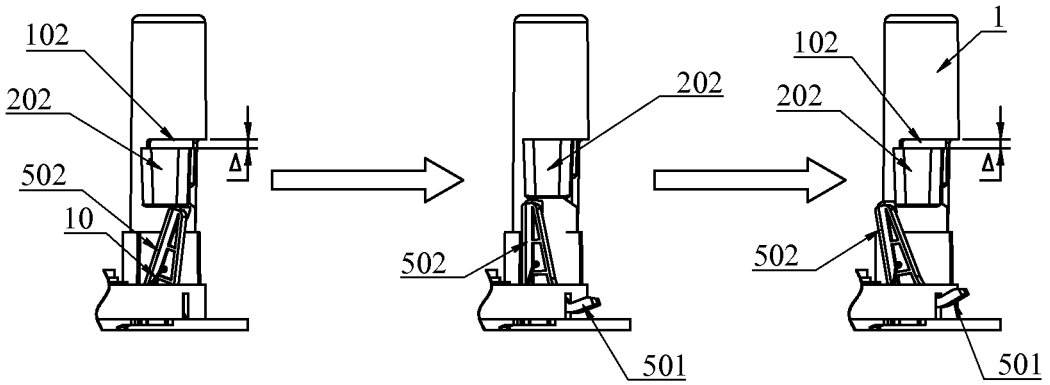
FIG. 17 is a side view illustrating how each actuating unit returns to its original position.

As illustrated in FIGS. 16 and 17, after the locking unit 200 is unlocked, we use the hex key 500 to push the vertical cylindrical part 201 upwards. Now, the horizontal part 202 goes up vertically and the actuating unit 5 returns to its original position thanks to the torsion spring 10.

Alternatively, the four actuating units 5 may not be used. If so, either in installation of disassembly, we need to use a hex key 500 to push up and rotate the lower cylindrical portion. This means installation would cause a bit more trouble.

The speaker's fast installation assembly of the present invention is structurally simple, safe and sturdy and has a longer service life. Because most of its parts may be manufactured by injection molding, its cost is relatively lower. In addition, its installation and disassembly are simple and easy; therefore, efficiency is greatly enhanced. Moreover, no damage would be done to the ceiling in its installation and disassembly. Furthermore, it may be installed in ceilings and walls in a wide range of thickness.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A speaker's fast installation assembly, comprising:

a ring portion;

a plurality of fixing units, wherein each fixing unit comprises an upper cylindrical portion, a lower cylindrical portion and a spring, and wherein each lower cylindrical portion has an L shape and comprises a vertical cylindrical part and a horizontal part, which horizontally extends from a lower portion of the vertical cylindrical part, characterized in that the vertical cylindrical part may be upwardly inserted into a bore of the upper cylindrical portion and may move vertically inside the bore, and wherein a chamber is provided in the upper cylindrical portion and a fixing notch is provided in an upper portion of the chamber, and wherein the spring is mounted inside the bore of the upper cylindrical portion and between the top surface of the vertical cylindrical part and the bottom surface of the bore of the upper cylindrical portion, characterized in that the lower end of each upper cylindrical portion is fixedly connected to the ring portion and an installation hole is provided for each fixing unit in the ring portion, and characterized in that a slot is provided in the bottom surface of each vertical cylindrical part; and a plurality of actuating units, whose number equals that of the fixing units, characterized in that each actuating unit has an L shape, wherein each actuating unit comprises a trigger, an actuating portion and a pivotal pin, which acts as a pivotally connective device that can connect each actuating unit to the ring portion, and wherein a plurality of slots are circumferentially provided in an outer vertical wall of the ring portion so as to allow the triggers to stick out, characterized in that each trigger moves into the slot when each actuating portion is located by the corresponding fixing notch and each trigger moves out from the slot and reaches a position higher than the top surface of the ring portion when the corresponding actuating portion moves away from the corresponding fixing notch.

2. The speaker's fast installation assembly as in claim 1, wherein a protruding member is provided on a lower portion of either side of the upper cylindrical portion and a plurality of seating units, whose number equals that of the fixing units, are provided on the top surface of the ring portion, and wherein each seating unit has an inner space, which has a special shape to allow a tight fit with the two protruding members, characterized in that bolts or screws are used to fix the two protruding members onto the ring portion and that a slot, which faces outwards, is provided in each seating unit so as to provide room for the corresponding horizontal parts.

3. The speaker's fast installation assembly as in claim 2, wherein the ring portion has a ring shape, characterized in that the seating units and the holes of the seating units are disposed on top of the upper surface of the ring portion in a circumferentially equally spaced manner.

4. The speaker's fast installation assembly as in claim 1, wherein the slot provided in the bottom surface of each vertical cylindrical part may be a slotted screwdriver slot, a Phillips screwdriver slot or a hex key slot and the height of the fixing notch is greater than the height of the horizontal part.

5. The speaker's fast installation assembly as in claim 1, wherein a hole is provided inside the vertical cylindrical part so as to reduce the height of each fixing unit.

6. The speaker's fast installation assembly as in claim 1, wherein a slope that leads to a lower part of the fixing notch is provided in the upper cylindrical portion.

7. The speaker's fast installation assembly as in claim 1, wherein a torsion spring is provided for each actuating unit and the ring portion of a torsion spring is mounted on the pivotal pin, characterized in that the stationary member of the torsion spring is affixed to the ring portion and the movable member of the torsion spring is attached to the actuating portion, and characterized in that each torsion spring may cause the corresponding trigger to jump up and stick out the corresponding slot and to reach a position higher than the top surface of the ring portion and to prompt the actuating portion to move away from the fixing notch.

8. The speaker's fast installation assembly as in claim 1, wherein a U-shaped plate and a screw are provided for each actuating unit and each U-shaped plate may press downwards on the pivotal pin, and wherein a seating unit is provided for each actuating unit in the ring portion and has two indentations to hold the pivotal pin in position, characterized in that each screw may affix the corresponding U-shaped plate onto each seating unit.

9. The speaker's fast installation assembly as in claim 1, characterized in that in installation, first, a hex key or other tool is used to push the lower cylindrical portion of each of the four fixing units inwards through the installation hole and then, as the top surface of the ring portion approaches a ceiling or wall, the circular perimeter of the opening pushes the four triggers downwards to cause the actuating portion to move the horizontal part outwards so that with the aid of the spring, the horizontal part would slide down along the slope and the chamber and presses downwards on the ceiling, firmly affixing the installation assembly and the speaker to the ceiling, and characterized in that in disassembly, a hex key or other tool is pushed inwards to reach the hex slot located in the bottom surface of the vertical cylindrical part and then the hex key is pushed all the way into the hex slot and turn it in the counter-clockwise direction to rotate the lower cylindrical portion so that the horizontal part of the lower cylindrical portion moves up inside the chamber and moves into the fixing notch and then is locked in the fixing notch and that the actuating unit returns to its original position thanks to the torsion spring.

* * * * *